US009108644B2

(12) United States Patent
Steffen et al.

(10) Patent No.: US 9,108,644 B2
(45) Date of Patent: Aug. 18, 2015

(54) FUEL PRESSURE ACTUATED COUPLING FOR TRAIN CONSIST

(71) Applicant: Electro-Motive Diesel, Inc., LaGrange, IL (US)

(72) Inventors: Joshua Wayne Steffen, El Paso, IL (US); Aaron Gamache Foege, Westmont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 98 days.

(21) Appl. No.: 13/661,592

(22) Filed: Oct. 26, 2012

(65) Prior Publication Data

US 2014/0116283 A1 May 1, 2014

(51) Int. Cl.

| | |
|---|---|
| ***B61C 5/00*** | (2006.01) |
| ***B61D 5/00*** | (2006.01) |
| ***B61G 5/08*** | (2006.01) |
| ***B61C 17/02*** | (2006.01) |
| ***B61G 3/10*** | (2006.01) |

(52) U.S. Cl.

CPC . *B61C 5/00* (2013.01); *B61C 17/02* (2013.01); *B61D 5/00* (2013.01); *B61G 3/10* (2013.01); *B61G 5/08* (2013.01)

(58) Field of Classification Search

CPC ..... B61G 5/08; B61G 7/14; B61G 3/10; B61C 5/00; B61C 17/02; B61D 5/00

USPC ..... 213/2, 3, 76, 119, 148, 149, 159

See application file for complete search history.

(56) References Cited

U.S. PATENT DOCUMENTS

| | | | | |
|---|---|---|---|---|
| 4,391,380 | A * | 7/1983 | Hoose | 213/76 |
| 4,688,830 | A | 8/1987 | Meisinger et al. | |
| 5,375,580 | A * | 12/1994 | Stolz et al. | 123/527 |
| 5,887,567 | A | 3/1999 | White et al. | |
| 5,966,970 | A | 10/1999 | Mooney | |
| 6,408,766 | B1 * | 6/2002 | McLaughlin et al. | 105/231 |
| 6,564,956 | B2 | 5/2003 | Daugherty, Jr. | |
| 7,909,365 | B2 | 3/2011 | Krywitsky | |
| 7,938,456 | B2 | 5/2011 | Chambaud et al. | |
| 8,186,649 | B2 | 5/2012 | Aoki | |
| 2006/0038401 | A1 | 2/2006 | Kleinbeckel et al. | |

* cited by examiner

*Primary Examiner* — Mark Le

(74) *Attorney, Agent, or Firm* — Finnegan, Henderson, Farabow, Garrett & Dunner, LLP

(57) ABSTRACT

A coupling system for a train consist is disclosed. The coupling system may include a first conduit associated with a locomotive of the train consist, a second conduit associated with a tender car of the train consist, and a fluid coupling connecting the first and second conduits. The coupling system may also include a first mechanical coupler associated with the locomotive and a second mechanical coupler associated with the tender car and configured to engage and lock with the first mechanical coupler. The coupling system may further include a locking device driven by fluid passing through the fluid coupling that is configured to inhibit disengagement of the first mechanical coupler and the second mechanical coupler.

16 Claims, 2 Drawing Sheets

FUEL PRESSURE ACTUATED COUPLING FOR TRAIN CONSIST

TECHNICAL FIELD

The present disclosure relates generally to a coupling for a train consist and, more particularly, to a coupling that is actuated by fuel pressure.

BACKGROUND

Natural gas has been used as fuel for internal combustion engines in consist locomotives. Because natural gas has a lower volumetric energy density than traditional fuels, such as diesel and gasoline, the natural gas used by the locomotives is generally only practical to store in a liquefied state ("LNG"). At atmospheric pressures, the natural gas must be chilled to below about −160° C. to remain in liquid form. Consists having LNG-fueled locomotives store the LNG in insulated tank cars (a.k.a., tender cars) that are towed by the locomotive.

The tender car and the LNG-fueled locomotive are connected via a mechanical coupling, which allows the tender car to be towed by the locomotive. A fuel line connection between the locomotive and tender car allows fuel to be supplied from the insulated tank to the internal combustion engine of the locomotive. In order to prevent tender cars from being stolen or inadvertently disconnected, a locking device for the mechanical coupling is desirable.

One example of a device used in a coupling system for locomotives is described in U.S. Pat. No. 6,564,965 ("the '965 patent") of Daugherty Jr. that issued on May 20, 2003. The '965 patent describes a joining member that is engageable with at least one shalt member and a portion of an opening formed through a side wall portion. The joining member is used for securing a connection assembly to a female connection member and thereby securing a male connection member to the female connection member to form an articulated type coupling arrangement.

Although the joining member of the '965 publication may be capable of securing a connection assembly, it may not present solutions in the event that the joining member should fail. It is possible that, with extensive use, the joining member may become worn and corroded, which could incidentally cause the coupling arrangement to disengage. If this were to occur, there would not be a backup strategy to prevent the two locomotives from separating.

The system of the present disclosure solves one or more of the problems set forth above and/or other problems with existing technologies.

SUMMARY

In one aspect, the disclosure is directed to a coupling system for a train consist. The coupling system may include a first conduit associated with a locomotive of the train consist, a second conduit associated with a tender car of the train consist, and a fluid coupling connecting the first and second conduits. The coupling system may also include a first mechanical coupler associated with the locomotive and a second mechanical coupler associated with the tender car that is configured to engage and lock with the first mechanical coupler. The coupling system may further include a locking device driven by fluid passing through the fluid coupling that is configured to inhibit disengagement of the first mechanical coupler and the second mechanical coupler.

In another aspect, the disclosure is directed to a method of connecting a tender car to a locomotive. The method may include establishing a mechanical coupling and a fluid communication between the locomotive and the tender car. The method may further include using the fluid communication to inhibit disengagement of the mechanical coupling.

DETAILED DESCRIPTION

Figure 1:
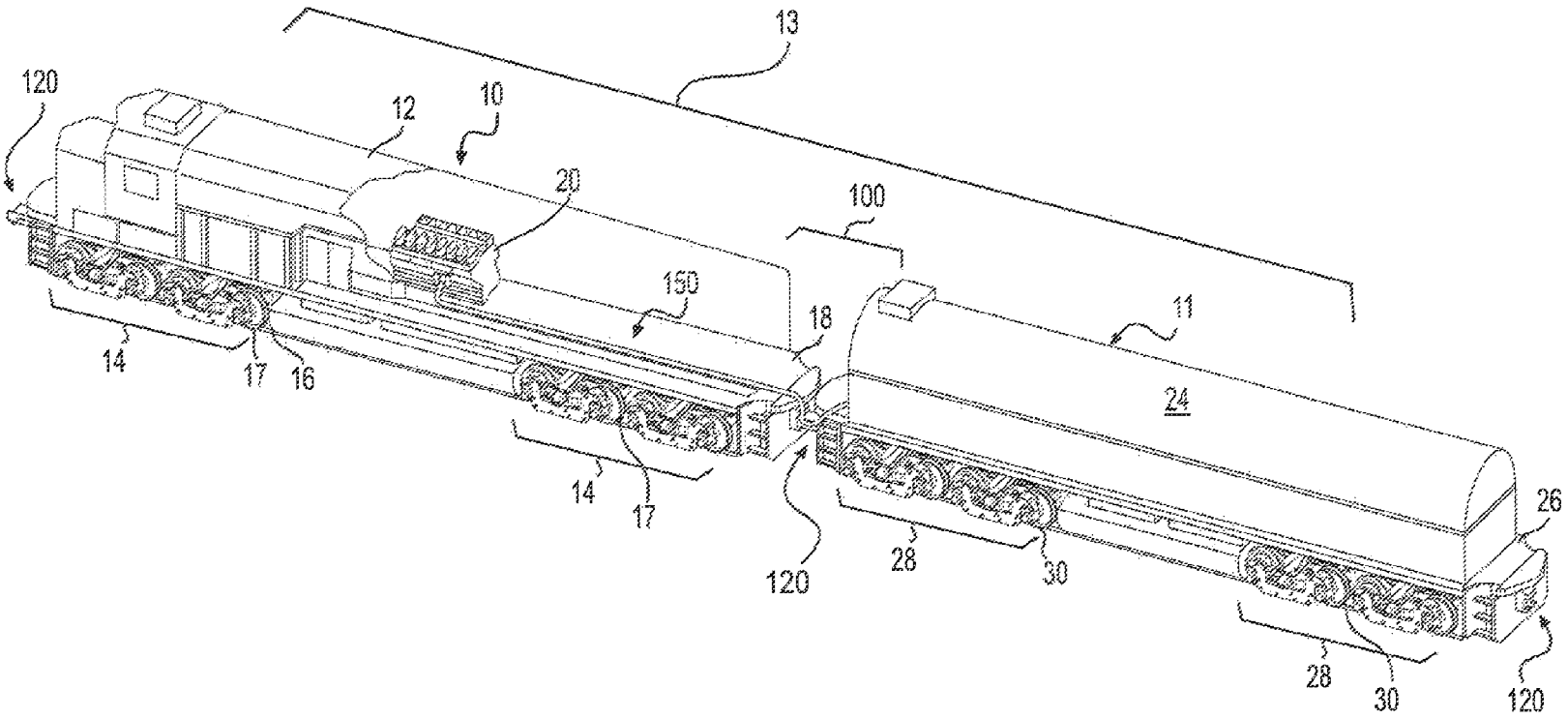
FIG. 1 is a pictorial illustration of an exemplary disclosed coupling system for a train consist.

FIG. 1 illustrates an exemplary embodiment of a locomotive 10 and a tender oar 11 that is towed by locomotive 10. In some embodiments, additional cars may be towed by locomotive 10, for example, a passenger car (not shown), a cargo container car (not shown), or another type of car. Together, locomotive 10, tender car 11 and the other cars connected to them may comprise a consist 13.

Locomotive 10 may include a car body 12 supported at opposing ends by a plurality of trucks 14 (e.g., two trucks 14). Each truck 14 may be configured to engage a track 16 via a plurality of wheels 17, and support a frame 18 of car body 12. Engine 20 may be mounted to frame 18 and configured to produce electricity that drives wheels 17 included within each truck 14.

Engine 20, in the disclosed embodiment, may have sixteen cylinders and a rated power output of about 4,000 brake horsepower (bhp). It should be noted, however, that engines with other suitable number of cylinders or rated power outputs may alternatively be utilized. Engine 20 may be configured to combust a gaseous fuel, such as natural gas, and generate a mechanical output that drives a generator (not shown) capable of producing electric power. The electrical power may be used to generate the propulsive force of consist 13 via traction motors (not shown). Engine 20 may be an LNG-engine (Liquefied Natural Gas Engine) or another type of fuel-powered engine.

Tender car 11 may include one or more tanks 24 configured to store a liquid fuel (e.g., LNG) for combustion within engine 20. In the disclosed embodiment, a single tank 24 is shown. Tank 24 may be an insulated, single or multi-walled tank configured to store the liquid fuel at low temperatures, such as below about −160° C. Tank 24 may be mounted to a frame 26 configured to be pulled by locomotive 10. Frame 26 may be supported by a plurality of trucks 28 (e.g., two trucks 28). Similar to truck 14, each truck 28 may be configured to engage track 16 via a plurality of wheels 30.

A coupling system 100 may be disposed between locomotive 10 and tender car 11, allowing tender car 11 to be connected to and towed by locomotive 10. Coupling system 100 may include one or more mechanical couplers 120 and a fuel delivery circuit 150 operably connecting tender car 11 to locomotive 10. In the embodiment shown in FIG. 1, locomotive 10 and tender car 11 each have two mechanical couplers 120, one located at a front end and one located at a rear end (referring to the direction of travel). In this manner, multiple locomotives 10 and tender cars 11 can be serially connected. It is contemplated that in alternative embodiments tender car 11 may be located in front of locomotive 10 and may still be operably connected.

Figure 2:
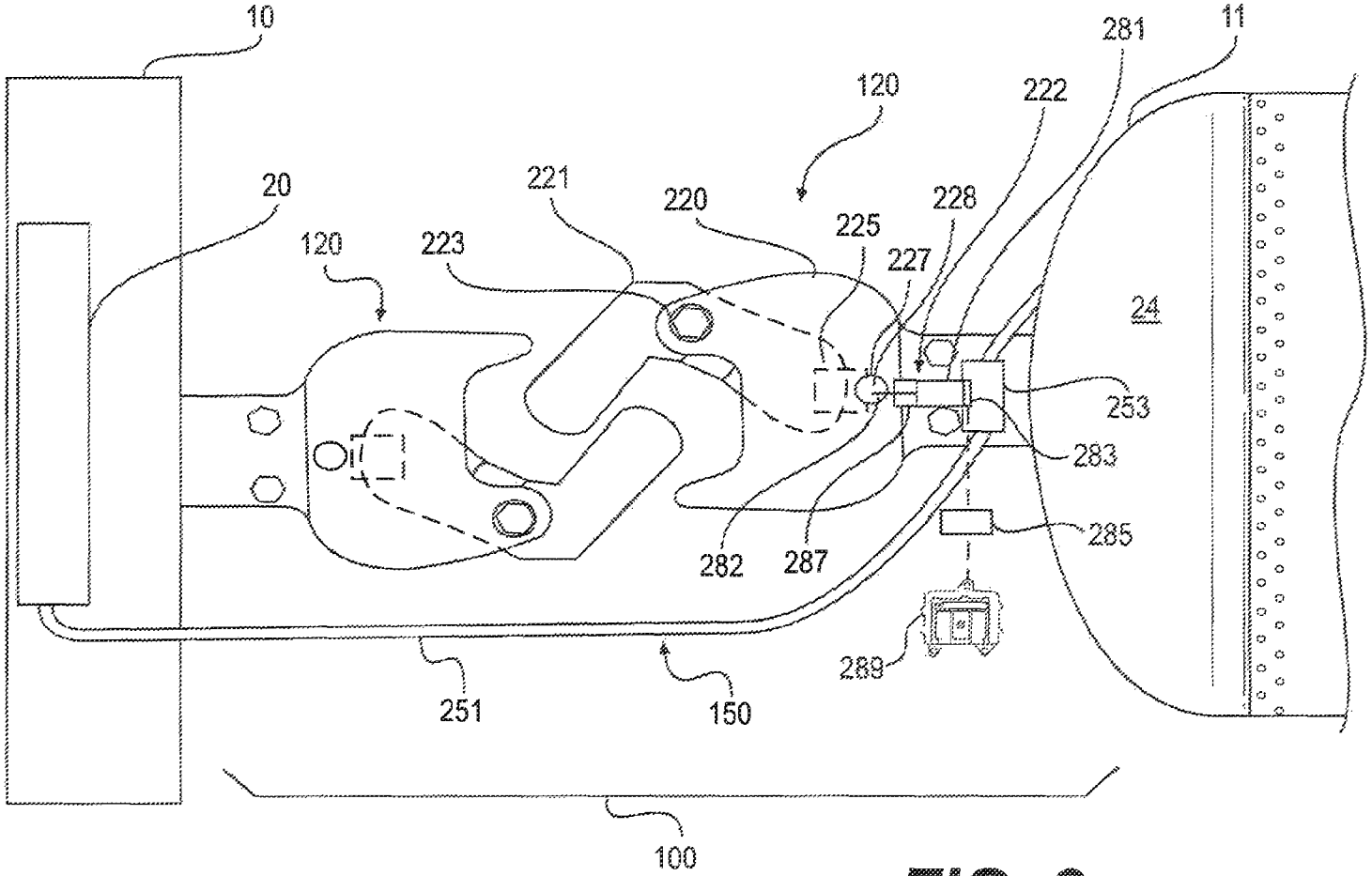
FIG. 2 is a diagrammatic illustration of a top view of the exemplary coupling system displayed in FIG. 1.

As illustrated in FIG. 2, mechanical coupler 120 may include a body portion 220, a knuckle portion 221, a pivoting pin 223, a primary lock 225, and a locklift 227 configured to allow mechanical coupler 120 to engage and lock with other mechanical couplers 120. In the embodiment of FIG. 2, two mechanical couplers 120 are shown. One mechanical coupler 120 is attached to locomotive 10, while the other mechanical coupler 120 is attached to tender car 11. For the purposes of this disclosure, both mechanical couplers 120 may be substantially the same in their components and functionality. This may allow the two mechanical couplers 120 to engage and lock with one another to securely connect locomotive 10 and tender car 11.

Knuckle portion 221 and body portion 220 of mechanical coupler 120 may be pivotably connected by pivoting pin 223. Pivoting pin 223 may be configured to allow knuckle portion 221 to rotate relative to body portion 220. In the embodiment shown, knuckle portion 221 may rotate freely about an axis defined by pivoting pin 223, while mechanical coupler 120 is unlocked. However, once mechanical coupler 120 engages with another mechanical coupler 120, mechanical coupler 120 may be locked by primary lock 225.

Primary lock 225 may be configured to lock mechanical coupler 120 by preventing knuckle portion 221 from rotating while mechanical coupler 120 is engaged with another mechanical coupler 120. Primary lock 225 may move from an elevated position to a lowered position in order to lock knuckle portion 221 in place. In the embodiment shown, both mechanical couplers 120 may lock simultaneously, when engaged, to inhibit both knuckle portions 221 from rotating and thereby ensuring a secure connection from both ends.

To unlock mechanical couplers 120 and release knuckle portions 221, locklift 227 may be configured to move primary lock 225 from the lowered position back to the elevated position. Locklift 227 may be fixedly attached to primary lock 225 and provide an operator with external access to unlock mechanical couplers 120. Additionally, locklift 227 may contain one or more openings 228 to aid in securing the connection between mechanical couplers 120.

Fuel delivery circuit 150 may include components that cooperate to deliver liquid fuel stored in tank 24 toward engine 20 in gaseous form. As shown in FIG. 2, fuel delivery circuit 150 includes one or more conduits 251 and fluid couplings 253. Fuel delivery circuit 150 may also include, among other things, conventional pumps, valves, heat exchangers, accumulators, and injectors (not shown) configured to condition and deliver low-temperature liquid fuel from tank 24 toward engine 20 in gaseous form, as known in the art.

Conduits 251 may connect tank 24 to engine 20 and allow passage of fluid (e.g. natural gas) from tank 24 towards engine 20. Two or more conduits 251 may be in fluid communication in fuel delivery circuit 150 with at least one conduit 251 attached to engine 20 and another conduit 251 attached to tank 24. One or more fluid couplings 253 (e.g. fuel quick-disconnect couplings) may connect conduits 251 and establish the fluid communication between them. Fluid coupling 253 and conduits 251 may be made of any flexible material known to the art for use in delivery of fuel, especially materials applicable for delivery of low-temperature fuel.

In the embodiment shown in FIG. 2, conduits 251 and fuel coupling 253 may be at least partially disposed within or otherwise fluidly connected to mechanical coupler 120. Additionally, it is contemplated that there may be more conduits 251 and fluid couplings 253 involved in fuel delivery circuit 150. For example, there may be two parallel fuel lines to supply fuel from tank 24 to engine 20. There may also be a number of additional components (e.g. accumulators) involved in fuel delivery circuit 150, which may require additional conduits 251 and fluid couplings 253.

Coupling system 100 may also include a locking device configured to inhibit disengagement of two connected mechanical couplers 120. For the purposes of this disclosure, the locking device may embody a piston 281 as shown in FIG. 2. Piston 281 may be in communication with an actuator 283, a pressure sensor 285, and a controller 289 to actuate piston 281 using pressure from fluid (e.g. natural gas) flowing through fuel delivery circuit 150. It should be noted that additional embodiments of the locking device may be used in order to utilize existing pressure of fluid flowing through fuel delivery circuit 150, as desired.

Piston 281 may be disposed within a chamber 222 located inside of mechanical coupler 120 to allow piston 281 to move between an unlocked position and a locked position. In one embodiment, as shown in FIG. 2, chamber 222 may be located within body portion 220 of mechanical coupler 120. Chamber 222 and/or piston 281 may also be connected to fluid coupling 253 as in the embodiment shown. Piston 281 may include a pin 282 and a spring 287 that are fixedly attached to piston 281. When actuated, piston 281 may be driven from the unlocked position to the locked position causing pin 282 to thread through opening 228 of locklift 227. Then, when piston 281 is no longer actuated, spring 287 may return piston 281 to the unlocked position.

Actuator 283 may be configured to drive piston 281 from the unlocked position to the locked position within chamber 222. Actuator 283 may be pneumatically driven using existing fluid pressure in fuel delivery circuit 150. For example, in one embodiment, actuator 283 may be driven by pressure of fuel passing through fluid coupling 253. Alternatively, or additionally, actuator 283 may be electrically driven through communication with pressure sensor 285 and controller 289. In some embodiments, actuator 283 may be considered integral with piston 281.

Pressure sensor 285 may be in communication with controller 289 and may generate a signal indicative of a pressure within fuel delivery circuit 150. Pressure sensor 285 may monitor the pressure level at a specified location within fuel delivery circuit 150 or at various locations of fuel delivery circuit 150.

Controller 289 may be operably connected to actuator 283 and pressure sensor 285 to selectively trigger driving piston 281 within chamber 222 based on the signal from pressure sensor 285. Controller 289 may be a single microprocessor or multiple microprocessors that include mechanisms for controlling an operation of piston 281. Numerous commercially available microprocessors can be configured to perform the functions of controller 289. It should be appreciated that controller 289 could readily be embodied in a general engine or machine microprocessor capable of controlling numerous engine and/or machine functions. Controller 289 may include a memory, a secondary storage device, a processor, and any other components for running an application. Various other circuits may be associated with controller 289 such as power supply circuitry, signal conditioning circuitry, solenoid driver circuitry, and other types of circuitry.

In the disclosed exemplary embodiment, controller 289 may be configured to cause actuator 283 to drive piston 281 from the unlocked position to the locked position in response to the signal produced by pressure sensor 285. This may cause pin 282 to thread through opening 228 of locklift 227, which may inhibit locklift 227 from moving primary lock 225 to the elevated position. While piston 281 is in the locked position, this may also inhibit knuckle portion 221 from rotating relative to body portion 220 and lock mechanical coupler 120. To unlock mechanical coupler 120, controller 289 may disable actuator 283, allowing spring 287 to return piston 281 to the unlocked position. This may then allow locklift 227 to move primary lock 225 to the elevated position and release knuckle portion 221.

For the purposes of this disclosure, piston 281 may be actuated when the pressure within the fuel deliver circuit 150 is above a threshold pressure level and deactivated when the pressure is below the threshold pressure level. For example, when the pressure is above the threshold pressure level, this may indicate that fuel is traveling through fuel delivery circuit 150, and piston 281 may be actuated. Conversely, when the pressure has dropped below the threshold pressure level, this may indicate that the fuel is no longer traveling through fuel delivery circuit 150, and piston 281 may be deactivated.

It is contemplated that piston 281 may be driven without actuator 283, pressure sensor 285, and/or controller 289. Instead, piston 281 may move between the unlocked position and the locked position based on the pressure contained within fuel delivery circuit 150. For instance, when fuel is flowing through fuel delivery circuit 150, existing pressure may cause piston 281 to move into the locked position. Then, once fuel stops flowing through fuel delivery circuit 150, spring 287 may return piston 281 to the unlocked position.

In an alternative embodiment, chamber 222 may instead be disposed within knuckle portion 221 of mechanical coupler 120. Conduits 251, fluid coupling 253, and piston 281 may all be at least partially disposed within knuckle portion 221 as well. In this embodiment, when the pressure within fuel delivery circuit 150 is above the threshold pressure level, piston 281 may be actuated to cause pin 282 to inhibit rotation of knuckle portion 221. Pin 282 may move from an elevated position to a lowered position similar to primary lock 225 to inhibit rotation of knuckle portion 241. Alternatively, pin 282 may thread through an opening in body portion 220 to inhibit rotation of knuckle portion 221. This alternative embodiment may help to provide additional security to coupling system 100 in similar ways as the embodiments discussed above.

It is also contemplated that in an alternative embodiment, coupling system 100 may include a piston 281 disposed in both mechanical couplers 120 shown in FIG. 2. Both pistons 281 may be substantially the same and configured to actuate simultaneously when fluid is present hi fuel delivery circuit 150. This embodiment may provide even greater security by ensuring a connection between locomotive 10 and tender car 11 from both ends.

INDUSTRIAL APPLICABILITY

The disclosed coupling system 100 may be applicable to any consist 13 utilizing a fuel distribution system. The disclosed coupling system 100 may help to improve the connection between locomotive 10 and tender car 11. Specifically, the disclosed coupling system 100 may provide a backup strategy in case of failure of primary lock 225 and/or locklift 227. In addition, the disclosed coupling system 100 may help ensure that a reduced volume of fuel is lost due to improper or unexpected disconnection of tender car 11. In this manner, the disclosed coupling system 100 may improve the safety and efficiency of LNG-fueled locomotive operations.

In the disclosed coupling system 100, fluid (e.g. natural gas) may flow through one or more conduits 251 and fluid couplings 253 in fuel delivery circuit 150 to establish fluid communication between tank 24 located on tender car 11 and engine 20 located on locomotive 10. The disclosed coupling system 100 may also establish a mechanical coupling between locomotive 10 and tender car 11 using one or more mechanical couplers 120. Additionally, the disclosed coupling system 100 may use the fluid communication to inhibit disengagement of the mechanical coupling.

When fuel is present in fuel delivery circuit 150, pressure sensor 285 may generate a signal indicative of the pressure level, which may be received by controller 289. Controller 289 may then determine the pressure level of fuel delivery circuit 150 or a specific location within fuel delivery circuit 150. For example, pressure sensor 285 may measure the pressure level of fluid flowing through fluid coupling 253. If the pressure level is above a threshold pressure level, controller 289 may be configured to cause actuator 283 to drive piston 281 within chamber 222 from the unlocked position to the locked position. Pin 282 may then thread through opening 228 of locklift 227 to inhibit locklift 227 from moving primary lock 225 to the elevated position. This may inhibit rotation of knuckle portion 221 and prevent disengagement of mechanical couplers 120 during operation of locomotive 10.

When operation of locomotive 10 has stopped, the fuel may be drained to tank 24 and/or an accumulator (not shown) of fuel delivery circuit 150. This may cause the pressure level to drop below the threshold pressure level. In this situation, controller 289 may be configured to disable actuator 283 when fluid communication has been disrupted. Spring 287 may then return piston 281 to the unlocked position allowing locklift 227 to move primary lock 225 to the elevated position and release knuckle portion 221 and thereby, disengage mechanical couplers 120.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A coupling system for a train consist, comprising:
- a first conduit associated with a locomotive of the train consist;
- a second conduit associated with a tender car of the train consist;
- a fluid coupling connecting the first and second conduits;
- a first mechanical coupler associated with the locomotive;
- a second mechanical coupler associated with the tender car and configured to engage and lock with the first mechanical coupler;
- a locking device configured to inhibit disengagement of the first mechanical coupler and the second mechanical coupler, the locking device driven by fluid passing through the fluid coupling, wherein the fluid passing through the fluid coupling is fuel for the train consist;
- a pressure sensor configured to generate a signal indicative of the pressure of the fuel;
- an actuator configured to drive the locking device from an unlocked position to a locked position; and
- a controller configured to cause the actuator to drive the locking device based on the signal from the pressure sensor.

2. The coupling system of claim 1, wherein the locking device is a piston driven by pressure of the fluid.

3. The coupling system of claim 2, further including a spring configured to return the piston to the unlocked position based on the signal from the pressure sensor.

4. The coupling system of claim 3, wherein the second mechanical coupler includes:
- a body portion;

a knuckle portion pivotably connected to the body portion;

a pivoting pin configured to allow rotation of the knuckle portion relative to the body portion;

a primary lock configured to inhibit the rotation of the knuckle portion; and a locklift fixedly attached to the primary lock and configured to move the primary lock from a lowered position to an elevated position to release the knuckle portion.

5. The coupling system of claim 4, wherein the piston is at least partially disposed within a chamber of the second mechanical coupler, the chamber allowing the piston to move between the unlocked position and the locked position.

6. The coupling system of claim 5, wherein the knuckle portion is inhibited from rotating while the piston is in the locked position.

7. The coupling system of claim 6, wherein the chamber is at least partially disposed within the knuckle portion.

8. The coupling system of claim 6, wherein the chamber is at least partially disposed within the body portion.

9. The coupling system of claim 8, wherein the piston causes a pin to thread through an opening of the locklift and inhibit the locklift from moving the primary lock to the elevated position while the piston is in the locked position.

10. A train consist, comprising:

a locomotive;

a tender car;

an internal combustion engine disposed on the locomotive;

a fuel tank disposed on the tender car;

a first conduit associated with the engine;

a second conduit associated with the fuel tank;

a fluid coupling connecting the first and second conduits;

a first mechanical coupler associated with the locomotive;

a second mechanical coupler associated with the tender car and configured to engage and lock with the first mechanical coupler;

a locking device configured to inhibit disengagement of the first mechanical coupler and the second mechanical coupler, the locking device driven by pressure of fluid passing through the fluid coupling;

a pressure sensor configured to generate a signal indicative of the pressure of the fluid;

an actuator configured to drive the locking device from an unlocked position to a locked position: and a controller configured to cause the actuator to drive the locking device based on the signal from the pressure sensor.

11. The train consist of claim 10, wherein the locking device is a piston driven by the pressure of the fluid.

12. The train consist of claim 11, further including a spring configured to return the piston to the unlocked position based on the signal from the pressure sensor.

13. The train consist of claim 12, wherein the first mechanical coupler further includes:

a body portion;

a knuckle portion pivotably connected to the body portion;

a pivoting pin configured to allow rotation of the knuckle portion relative to the body portion;

a primary lock configured to inhibit the rotation of the knuckle portion; and a locklift fixedly attached to the primary lock and configured to move the primary lock from a lowered position to an elevated position to release the knuckle portion.

14. The train consist of claim 13, wherein the piston is at least partially disposed within a chamber of the second mechanical coupler, the chamber allowing the piston to move between the unlocked position and the locked position.

15. The train consist of claim 14, wherein the piston causes a pin to thread through an opening of the locklift to inhibit the locklift from moving the primary lock to the elevated position while the piston is in the locked position.

16. The train consist of claim 15, wherein the fuel tank is configured to hold liquefied natural gas ("LNG"), and the locking device is actuated by gasified natural gas.

* * * * *